US005996844A

United States Patent [19]

Ito

[11] Patent Number: 5,996,844

[45] Date of Patent: Dec. 7, 1999

[54] DISPENSING CONTAINER FOR LIQUID

[75] Inventor: Hiroyuki Ito, Chatsworth, Calif.

[73] Assignee: Mitsubishi Pencil Corporation of America, Chatsworth, Calif.

[21] Appl. No.: 09/020,890

[22] Filed: Feb. 9, 1998

[51] Int. Cl.[6] ..... B67D 5/00

[52] U.S. Cl. ..... 222/85; 222/478; 141/329; 141/330

[58] Field of Search ..... 222/82, 83, 85, 222/478; 141/329, 330

[56] References Cited

U.S. PATENT DOCUMENTS 4,846,369 7/1989 Dunstan ..... 222/85

5,595,223 1/1997 Hayao ..... 141/330

5,694,990 12/1997 Crima ..... 222/85

*Primary Examiner*—Philippe Derakshani

*Attorney, Agent, or Firm*—Koda & Androlia

[57] ABSTRACT

A container for storing liquids such as ink to be refilled in an used, empty ink cartridge for computer printers being to be formed with at least two holes so as to allow the ink to discharge. A hole is made in the container at its mouth portion and then another hole is opened at the main chamber of the container by a piercing device attached to the container or by revealing an air passage so as to introduce external air into the container so as to pressure out the ink into the ink cartridge.

8 Claims, 3 Drawing Sheets

DISPENSING CONTAINER FOR LIQUID

BACKGROUND OF THE INVENTION

1. Field of the Invention

The present invention relates to a liquid container and more particularly to a liquid container for dispensing the contents into a separate receptacle.

2. Prior art

Containers for storing liquids therein such as ink, medicine, etc. generally come in two types: a syringe type and a squeeze type. Either type of container needs to receive a pressure from out side to discharge the contents. In other words, in the cyringe type container, a piston is pushed into the container body which is customarily made of a hard material such as grass, etc; and in the squeeze type container, the container body which is generally made of elastic material such as synthetic resins is squeezed by fingers.

In these types of containers, a means for filling and discharging the inside liquid is generally provided at the mouth portion of the container; accordingly, a caution is required so that the inside liquid does not leak out of the container through these filling and discharging means during the transportation and storage.

Recently, it is a common practice of computer users to refill a used, empty ink cartridges for ink-jet printers with refilling ink; and such a refilling ink comes in special ink containers or ink packs. In other words, such ink containers or ink packs are provided at the mouth portion thereof with special ink discharging means that helps a smooth transfer of the ink from the container to the ink cartridge. Thus, since the container has the special discharge means, chances are that the ink leaks out of the container through such special discharging means or through incomplete sealing areas. Thus, a caution is highly required during the transportation and storage of such ink containers; and further, the manufacturing cost of such ink containers tends to be high.

There is another type of container which has a slight similarity to the present invention described later. This container is made of a material that has a rigidity, and the container has two (2) rubber capping members: one for covering the mouth portion and the other for covering the bottom opening. When this container is used, a pipe is pierced into the rubber member of the mouth portion, and then the other rubber member covering the bottom of the container is removed, thus introducing air into the container through the bottom opening, thus letting out the content, such as ink, into an empty ink cartridge. However, since two (2) capping members are used, it is difficult to secure an equally good sealing for both of them; and the same problem arise in this container as the container described above in terms of transportation, storage and manufacturing costs.

SUMMARY OF THE INVENTION

Accordingly, the object of the present invention is to provide a liquid container that can hold liquid inside without a possibility of leakage and can easily discharge the liquid out of the container.

It is another object of the present invention to provide a liquid container that has a means for introducing air inside upon use of the container so as to smoothly discharge the content.

It is still another object of the present invention to provide a puncture forming device which is mounted on the container upon use of the container so as to open an air intake hole in the container for allowing a smooth discharge of the content.

The above objects are accomplished by a unique structure for a liquid container that is made of plastic material, preferably polyolefin, and obtained by blow molding and is further sealed at an opening thereof provided at an end of the container after filling a liquid inside through the opening. Since the container, particularly the hollow main chamber thereof, is made of plastic material such as polyolefin, a hole can be easily opened; and in the present invention, such a hole is opened by a special piercing device or by peeling off a flap section of the container that is provided with an air passage inside, thus allowing the air to enter into the hollow main chamber of the container through the opened hole and letting the inside liquid be transferred through a mouth thereof into, for instance, a used empty ink cartridge for computer printers.

DETAILED DESCRIPTION OF THE INVENTION

Figure 1:
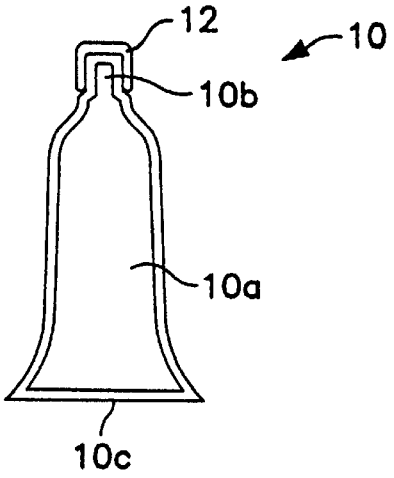
FIG. 1 shows a liquid container according to the first embodiment of the present invention.

As seen from FIG. 1, the container of the present invention which is generally referred to by a reference numeral 10 is made of a plastic material such as polyolefin, etc. and is formed into a tubular shape. The container 10 is obtained by blow molding and is comprised of a hollow main chamber 10*a*, a mouth portion 10*b*, and a tail end (or bottom) 10*c*, which are formed continuously. Typically, the hollow main chamber 10*a* is round in cross section in the direction of the diameter thereof and, as seen from FIG. 5, gradually flattened toward the tail end 10*c* that is located opposite from the mouth portion 10*b*. Thus, as seen from FIG. 1, the container 10 widens in the lateral direction toward the tail end 10*c;* and the mouth portion 10*b* is formed without any opening and has a smaller diameter than the main chamber 10.

Furthermore, a cap 12 made of, for example, rubber is securely attached or welded to the mouth portion 10*b* of the container 1 so as to cover the end area of the mouth portion 10*b*. The container 10 has an end opening (not shown) which is formed at the opposite end from the mouth portion 10*b* during the blow molding process, and then the liquid or ink is filled in the container through the end opening. When the container is filled with the liquid, the end opening is sealed so as to form the flattened tail end 10*c*, thus forming a sealed container 10 with liquids inside.

Figure 2:
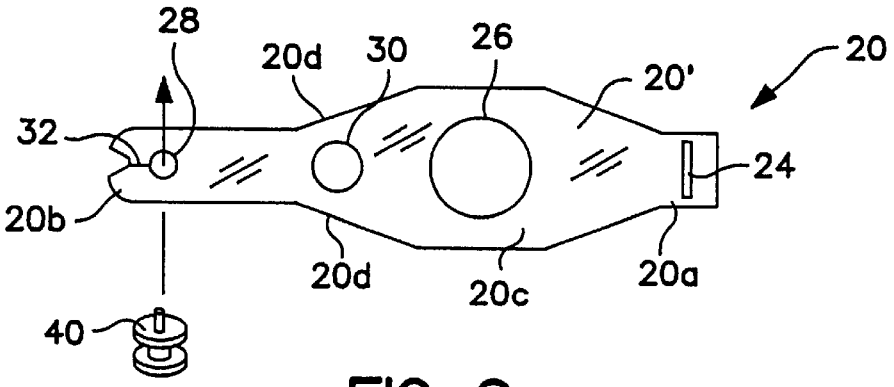
FIG. 2 shows a piercing device and a needle element attached thereto according to the present invention.

This container 10 is mounted with a piercing device 20. The piercing device 20, as shown in FIG. 2, comprises a flat elongated main plate 20' that is made of paper or flexible plastic, thus being bendable. The main plate 20' has a base end 20*a* and a tip end 20*b* that is located opposite from the base end 20*a*. The base end 20*a* of the main plate 20' is formed rectangular and is provided with a slit 24 that extends in the direction of the width of the elongated main plate 20'. Furthermore, the main plate 20' has an expanded central section 20*c* which is formed between the base end 20*a* and the tip end 20*b;* and this central section 20*c* is gradually narrowed in width toward the tip end 20*b* so as to have slanted side edges 20*d*.

Figure 3:
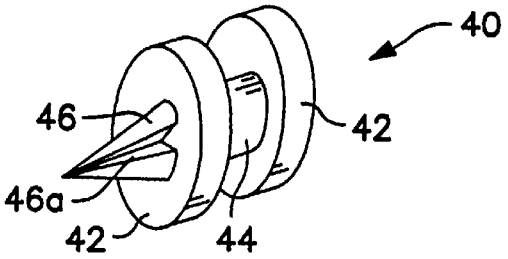
FIG. 3 is an enlarged view of the needle element.

A fitting hole 26 is opened in the central section 20*c* and an end hole 28 is opened at the tip end 20*b*; in addition, a positioning hole 30 is opened between the fitting hole 26 and the end hole 28. The fitting hole 26 has substantially the same diameter as that of the tubular container 10. Furthermore, the tip end 20*b* of the main plate 20' is bifurcated by an end cut 32 that extends in the direction of the length of the main plate 20' so that the end hole 28 is located at the inner end of the end cut 32, and a puncture element 40 as shown in FIG. 3 is attached to the main plate 20' via this end hole 28 as described later.

With the structure above, the piecing device 20 is mounted on the container 10.

When the piercing device 20 is mounted, the fitting hole 26 of the piercing device 20 is first brought over the mouth portion 10*b* of the container 10; and then the piercing device 20 is pushed towards the tail end 10*c* of the container 10 until the fitting hole 26 of the piercing device 20 fits tightly to the outer surface of the container 10 so that the piercing device 20 cannot be pushed further due to the flattened and laterally-expanded tail end 10*c* of the container 10.

Figure 4:
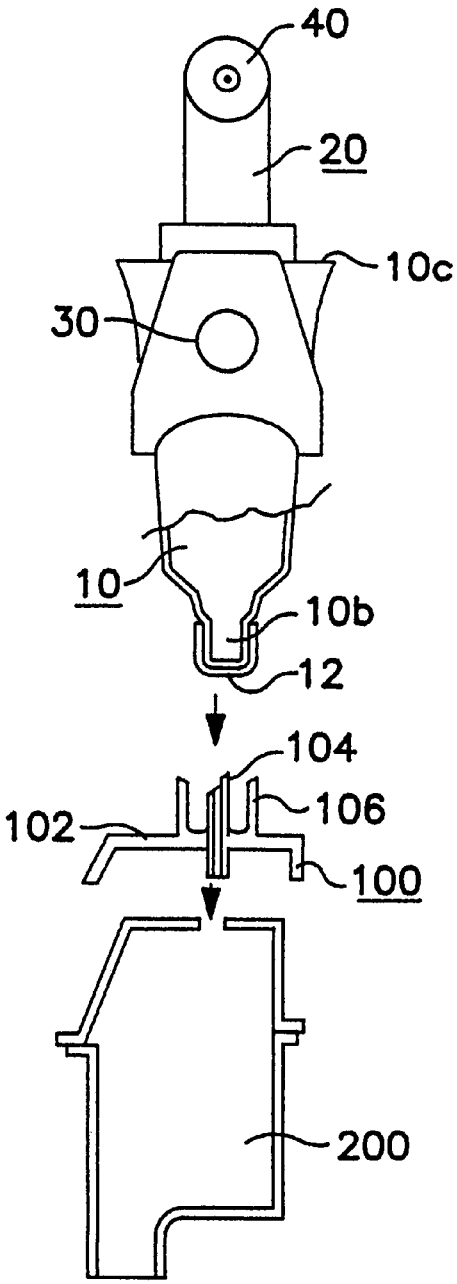
FIG. 4 illustrates the use of the container and piercing device of the present invention.
Figure 5:
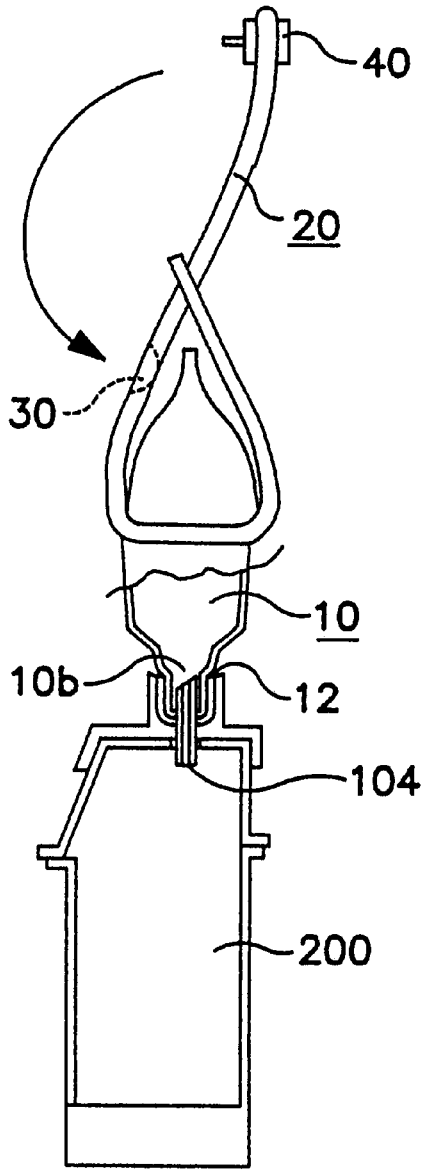
FIG. 5 is a side view thereof.

Then, the piercing device 20 is bent, as can be seen from FIG. 5, so that the base end 20*a* of the piercing device 20 is brought next to the tail end 10*c* of the container 10; and the tip end 20*b* of the piercing device 20 is passed through the slit 24 formed in the base end 20*a* and then pulled in the direction away from the tail end 10*c* of the container 10 until the slanted sides 20*d* of the piercing device 20 fit to both ends of the slit 24. As a result, the piercing device 20 is securely mounted to the container 10 as seen from FIGS. 4 and 5. Then, the puncture element 40 is attached to the piercing device 20.

The puncture element 40, as best shown in FIG. 3, is made of plastic and comprises a pair of disks 42, which are larger in diameter than the end hole 28 of the main plate 20'; and these disks 42 are connected to each other by a connecting bar 44. In addition, a needle 46 is formed on an outer surface of one of the pair of disks 42. The needle 46 is substantially a conical shape having a pointed end and is formed with a groove 46*a* in the outer surface thereof so that the groove 46*a* extends in the axial direction of the needle 46.

The puncture element 40 is attached to the main plate 20' (or the piercing device 20) by pushing the connecting bar 44 of the puncture element 40 into the end cut 32 until the connecting bar 44 is snapped into the end hole 28 of the main plate 20'. Once the puncture element 40 is thus pushed into the end hole 28, the puncture element 40 is prevented from coming out of the end hole 28 due to the elasticity of the bifurcated tip end 20*b* that closes the end cut 32 and due to the pair of disks 42 that have a larger diameter than the end hole 28.

When the piercing device 20 is thus mounted on container 10 with the puncture element 40 attached thereto, the container 10 which contains ink therein is set on an ink transfer means or adapter 100. One example of ink transfer adapter is disclosed in U.S. Pat. No. 5,595,223.

More specifically, an ink cartridge 200 used in a computer ink jest printer is held upright as shown in FIG. 4, and the ink transfer adapter 100 is set on the ink cartridge 200. The ink transfer adapter 100 comprises a base plate 102, a metal conduit 104 provided in the base plate 102 so as to pass therethrough, and a guide cylinder 106 surrounding the upper part of the metal conduit 104. When the transfer adapter 100 is set on the cartridge 200, the lower half of the metal conduit 104 is brought into the cartridge 200.

So as to set the container 10 on the ink transfer adapter 100, the container 10 on which the piercing device 20 is attached as described above is held by hand upside-down and brought to the adapter 100. The cap 12 covering the mouth portion 10*b* of the container 10 is pushed over the metal conduit 104 of the adapter 100 thus makes a communication between the inside of the main chamber 10*a* (or ink) of the container 10 and the inside of the ink cartridge 200 via the metal conduit 104 of the adapter 100.

Then, the piercing device 20 is bent as shown by an arrow in FIG. 5 so that the tip end 20*b* of the piercing device 20 is brought to the side of the container 10 until the pointed end of the needle 46 of the puncture element 40 attached to the tip end 20*b* of the piercing device 20 passes through the positioning hole 30 of the piercing device 20 and comes into contact with the exterior of the container 10. In the piercing device 20, the location of the positioning hole 30 is selected so as to be near the tail end 10*c* of the container 10 when the piercing device 20 is mounted on the container 10.

Then, the puncture element 40 is pushed by hand toward the container 10 so that the needle 46 penetrate through the container 10, thus making a puncture in the main chamber 10*a* of the container 10. Since the needle 46 is provided with an exterior axial groove 46*a* on its outer surface, exterior air can flow into the container 10 through this groove 46*a*; and air further enters into the container 10, particularly into the main chamber 10*a* thereof, through the puncture made by the puncture element 40 when the puncture element 40 is retrieved out of the container 10.

As a result, because of the air entered into the container 10, the ink inside the container 10 receives atmospheric pressure, and the ink inside is smoothly transferred into the cartridge 200 through the metal conduit 104 of the adapter 100.

When the cartridge 200 is filled with ink, the container 10 is pulled upward (or in the direction away from the adapter 100) and removed from the metal conduit 104 of the adapter 100. A puncture which had been formed in the cap 12 by the metal conduit 104 during the above-described procedure closes by its own elasticity so that any ink remaining inside the container 10 is prevented from leaking out; and the ink refilling is thus completed.

As seen from the above, with the container of the present invention, a discharge of the liquid (ink) stored inside the container is only commenced by opening two holes or punctures, first a hole in the mouth portion which is covered by the cap and then a hole in the hollow chamber of the container near the bottom thereof. Thus, a leakage of the liquid from the container is prevented during the period in which the container is not in use (such as transportation and storage), and then the liquid can be easily discharged by opening two holes or punctures in the container, so that the transfer of the container into another vessel (for instance, an ink cartridge) can be performed without squeezing the container or using forcing-out means such as a piston because of the air pressure applied onto the ink inside the container.

Though the needle 46 of the puncture element 40 described above is provided with the exterior axial groove 46*a* on its outer surface, the needle 46 may not be provided with the groove 46*a*. In this case, the exterior air flows into the container 10 through the puncture made by the needle 46 only after the puncture element 40 is retrieved out of the container 10.

Figure 6:
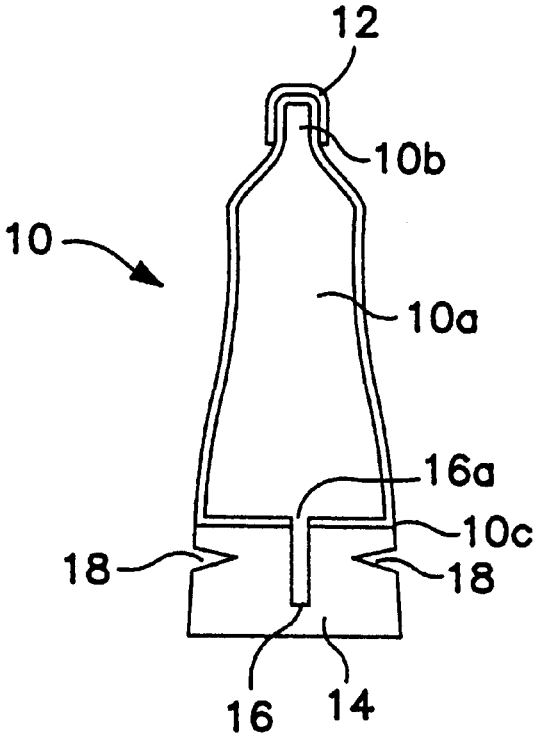
FIG. 6 shows a liquid container according to the second embodiment of the present invention.

FIG. 6 shows a second embodiment of the present invention.

The container 10 of this second embodiment is formed with a flap portion 14 that extends from the tail end 10*c* thereof, and a capillary passage 16 is formed in this flap portion 14 which, like the main chamber 10*a*, is made of a polyolefinic resin material. The capillary passage 16 extends in the direction of the length of the container 10, and one end 16*a* of the capillary passage 16 opens into the inside of the hollow main chamber 10*a* of the container 10.

The extended flap portion 14 is further provided with a pair of cutouts 18 on its both sides. The cutouts 18 are respectively V-shaped so that an imaginary straight line that connects these V-shape cutouts 18 crosses the capillary passage 16. Though the typical embodiment shown in FIG. 6 has a pair of cutouts 18 in the flap portion 14, it is possible to form a single cutout 18 on one side of the flap portion 14 so that an imaginary line extending towards the capillary passage 16 from the cutout 18 crosses the capillary passage 16.

In this container 10 of the second embodiment of the present invention, the flap portion 14 is formed during the sealing process of the opening which is located at the opposite end from the mouth portion 10*b* and through which the liquid is introduced into the main chamber 10*a*.

Figure 7:
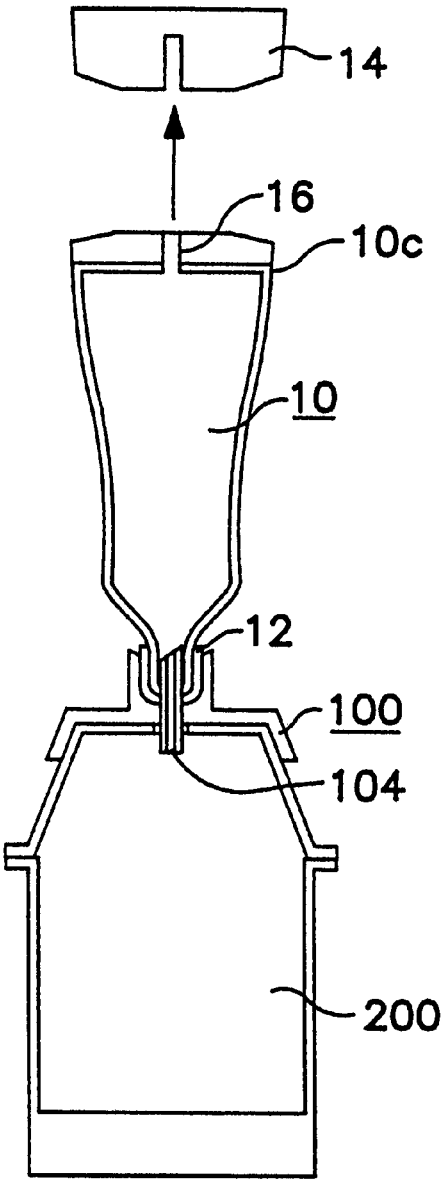
FIG. 7 illustrates the use of the container of the second embodiment of the present invention.

When the container 10 that has the flap portion 14 as described above is used, container is fitted to the adapter 100 in the same manner as in the first embodiment; and after the container 10 with ink therein is connected to the metal conduit of the adapter 100, a force is applied by fingers holding the flap portion 14 in the direction towards the depth of either one of the cutouts 18 so that the flap portion is removed from the hollow main chamber 10*a* of the container 10 along the imaginary line connecting the pair of cutouts 18 (or the imaginary line extending from the cutout to the passage 16). As a result, the capillary passage 16 is opened and exposed in the atmospheric air as shown in FIG. 7; and the exterior air enters into the main chamber 10*a* of the container 10 through the capillary passage 16, thus letting the ink flow out of the container 10 into the ink cartridge 200 through the metal conduit of the adapter 100.

As seen from the above, according to the present invention, an air communicating hole can easily be formed in the container such as ink container used for refilling an used, empty ink cartridge, while the inside content, the ink for instance, is assuredly prevented from leaking during transportation and storage.

In the described embodiments, the cap 12 is attached to the mouth portion 10*b* of the container 10. This cover 12 is employed mainly for the purpose of preventing the leakage during the dispensing process of the inside liquid. Accordingly, the cap 12 can be omitted when the container, particularly the mouth portion thereof, is made of a material that provide sufficient sealing properties to close the hole opened in the mouth portion.

The above embodiments described mainly with reference to refilling of ink into a used, empty ink cartridge for computer printers are to be considered in all respects as illustrative and not restrictive. All changes which come within the meaning and range of equivalency of the invention are to be embraced therein.

I claim:

1. A device for piercing a hole in a container which is made of a resin material, comprising an elongated flat plate member provided with a plurality of holes so that said elongated flat plate member, which is bendable, is fitted on said container via one of said plurality of holes and by engaging one end of said elongated flat plate member to another end of said elongated flat plate member, said device further comprising a puncture element attached to said another end.

2. A device according to claim 1, wherein said another end of said elongated flat plate member is provided with a slit so that said one end is passed through said slit thus allowing said one end to engage to said another end, and said puncture element is attached to said one end via another of said plurality of holes.

3. A device according to claim 1, wherein said puncture element comprising a pair of disks connected to each other by a connecting bar, and a needle means is provided on an outer surface of one of said pair of disks.

4. A device according to claim 3, wherein said needle means is formed with a groove extending in a direction of an axis of said needle means.

5. A device for piercing a hole in a container for storing liquids which is made by blow-molding a resin material and which has a cover covering a mouth portion of said container, said device being coupled to said container and comprising an elongated flat plate member provided with a plurality of holes so that said elongated flat plate member, which is bendable, is fitted on said container via one of said plurality of holes and by engaging one end of said elongated flat plate member to another end of said elongated flat plate member, said device further comprising a pure element for puncturing the container attached to said one end.

6. A device according to claim 5, said another end of said elongated flat plate member is provided with a slit so that said one end is passed through said slit thus allowing said one end to engage to said another end, and said puncture element is attached to said one end via another of said plurality of holes.

7. A device according to claim 5, wherein said needle means is formed with a pair of disks connected to each other by a connecting bar, and a needle means is provided on an other surface of one of said pair of disks.

8. A device according to claim 7, wherein said needle means is formed with a groove extending in a direction of an axis of said needle means.

* * * * *